US006634464B1

(12) United States Patent
Troyen

(10) Patent No.: US 6,634,464 B1
(45) Date of Patent: Oct. 21, 2003

(54) ELEVATOR POSITION INDICATOR DISPLAY SYSTEM AND METHOD OF DRIVING THE DISPLAY

(76) Inventor: Steven Troyen, 6025 Ward La., Levittown, PA (US) 19057

( * ) Notice: Subject to any disclaimer, the term of this patent is extended or adjusted under 35 U.S.C. 154(b) by 0 days.

(21) Appl. No.: 09/632,187

(22) Filed: Aug. 3, 2000

(51) Int. Cl.[7] ..... B66B 3/02
(52) U.S. Cl. ..... 187/399; 187/391
(58) Field of Search ..... 187/391, 393, 187/394, 397, 399; 345/33, 34, 38–40, 44, 46

(56) References Cited

U.S. PATENT DOCUMENTS 3,015,094 A * 12/1961 Reynolds ..... 345/44
3,146,436 A 8/1964 Crow ..... 340/336
3,737,707 A 6/1973 Yanagisawa ..... 313/109.5
3,967,700 A * 7/1976 Tur et al. ..... 187/29 R
3,995,719 A * 12/1976 Mandel et al. ..... 187/29 R
4,024,429 A 5/1977 Glaser ..... 315/169
4,157,501 A * 6/1979 Cain, Jr. et al. ..... 324/119
4,399,354 A * 8/1983 Schaffer ..... 377/26
4,853,619 A * 8/1989 Paulsen et al. ..... 324/115
5,644,326 A 7/1997 Lauzon et al. ..... 345/33
5,703,607 A 12/1997 Tai ..... 345/34
5,969,628 A 10/1999 Andre ..... 340/815.44
5,975,248 A * 11/1999 Lewis ..... 187/391
6,222,323 B1 * 4/2001 Yamashita et al. ..... 345/44

* cited by examiner

*Primary Examiner*—Jonathan Salata
(74) *Attorney, Agent, or Firm*—LaMorte & Associates

(57) ABSTRACT

A position indicator display system for an elevator. The elevator position indicator has a segmented display capable of producing alpha-numeric characters. The segmented display operates in a predetermined power range that may or may not match the operational voltage used by the rest of the elevator's systems. Within the elevator position indicator, a display driver is coupled to the segmented display. The display driver receives a location signal from the systems controller of the elevator. The display driver arranges the location signal to drive the segmented display and produce an alpha-numeric character indicative of the location signal. Since the elevator's operational voltage may differ from that of the elevator position indicator, a power conditioning circuit is provided. The power conditioning circuit selectively alters the power of the location signal so that the location signal falls within the operational power range of the segmented display.

15 Claims, 5 Drawing Sheets

ELEVATOR POSITION INDICATOR DISPLAY SYSTEM AND METHOD OF DRIVING THE DISPLAY

BACKGROUND OF THE INVENTION

1. Field of the Invention

The present invention relates to the design of position indicator displays for elevators. More particularly, the present invention relates to the circuitry used to drive a segmented display in the applications of an elevator position indicator.

2. Description of the Prior Art

Elevator position indicator displays are the displays that inform a person of the floor location of a particular elevator car at a particular moment in time. Elevator position indicator displays are commonly located in the lobby of buildings and within the actual cars of the elevator. The elevator position indicator display in the lobby of a building informs people in the lobby of the position and direction of the elevator car. In this manner they can gauge how long the wait will be before the elevator reaches the lobby. The elevator position indicator display within the elevator car informs a person of the floor level of the elevator so they know when to disembark the elevator car.

There are many different types of elevator position indicator displays, and there are no standards for their design. Additionally, different elevator systems operate at different supply voltages. Many elevator systems operate with twenty four volt power supplies. Other elevator systems are powered by one hundred and twenty volt power supplies. To further complicate matters, some elevator systems operate with alternating current, while others operate with direct current.

In addition to the wide range of power requirements used by various elevator systems, there is an equally large variety of position indicator displays in use. Although many of these position indicator displays use a segmented display to create alpha-numeric characters, the display drive circuits used to drive the segmented displays vary widely. The prior art of display diver circuits are exemplified by U.S. Pat. No. 5,644,326 to Lauzon, entitled, Display Device With Electrically Interconnected Display Elements; U.S. Pat. No. 5,703,607 to Tai, entitled Drive Circuit For Displaying Seven Segment Decimal Digit; U.S. Pat. No. 5,969,628 to Andre, entitled, Display Device For A 7-Segment Font; and U.S. Pat. No. 3,146,436 to Crow, entitled, Arabic Numeral Display Having Binary Code Conversion Matrix. Due to the complex designs of many display drive circuits, many displays are expensive to manufacture and complicated to repair.

Since elevators systems have different power requirements and vary in design, it is often difficult to repair or replace the elevator position indicator display used within that system. A need therefore exists in the art for a low cost versatile elevator position indicator display that can be retroactively added to most any elevator, regardless of the power specification used by that elevator. A need also exists for a simplified elevator position indicator display that uses a minimal amount of wiring and is easily maintained and repaired. These needs are met by the present invention as it is described and claimed below.

SUMMARY OF THE INVENTION

The present invention is a position indicator display system for an elevator. The elevator position indicator has a segmented display capable of producing alpha-numeric characters. The segmented display operates in a predetermined power range that may or may not match the operational voltage used by the rest of the elevator's systems. Within the elevator position indicator, a display driver is coupled to the segmented display. The display driver receives a location signal from the systems controller of the elevator. The display driver arranges the location signal to drive the segmented display and produce an alpha-numeric character indicative of the location signal. Since the elevator's operational voltage may differ from that of the elevator position indicator, a power conditioning circuit is provided. The power conditioning circuit selectively alters the power of the location signal so that the location signal falls within the operational power range of the segmented display.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention device can be adapted to drive segmented displays in a variety of application, the present invention device is particularly well suited to drive segmented displays that are part of an elevator position indicator. Accordingly, in order to present the best mode contemplated for the present invention device, the device will be described embodied as part of an elevator position indicator.

Figure 1:
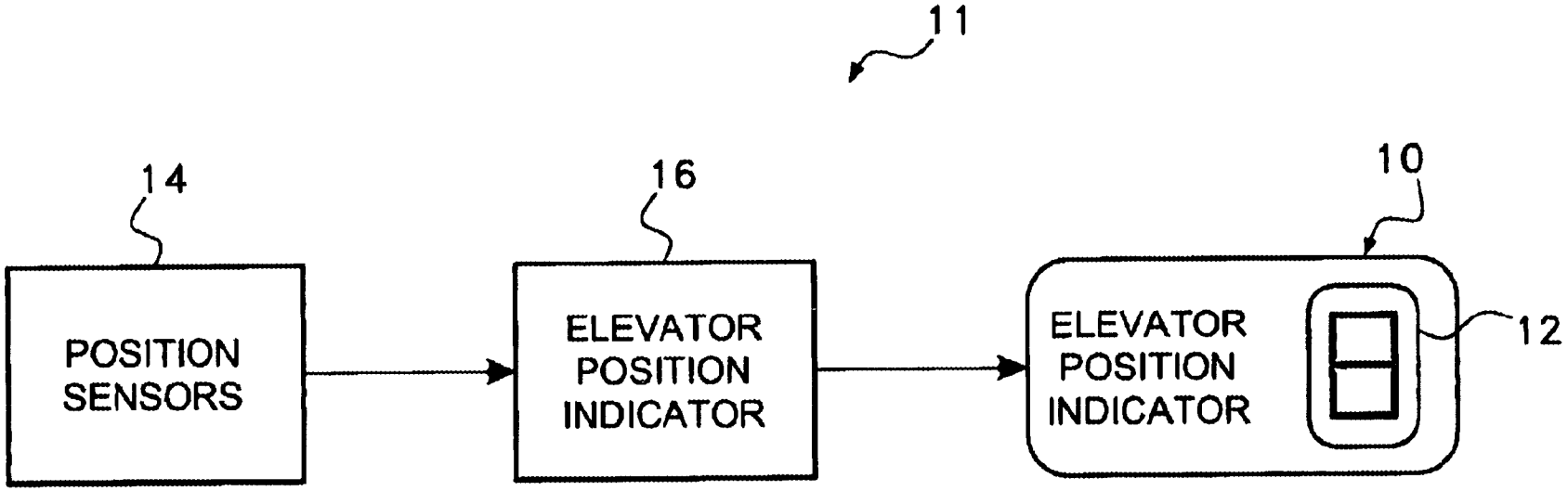
FIG. 1 is a schematic of an elevator system having an elevator position indicator.

Referring to FIG. 1, there is shown a schematic of an overall elevator system 11 as it relates to the elevator's systems controller 16 and the elevator position indicator. The elevator position indicator contains a digital segmented display 12 which is comprised of either seven separate segments or sixteen separate segments. The segmented display 12 itself can be either a back-lit liquid crystal display or a light emitting diode array, as is typical for segmented displays.

The elevator system 11 detects the position of the elevator car using various elevator sensors 14 that are positioned in the elevator shaft. The sensors read the position of the elevator car to the elevator systems controller 16. The elevator systems controller 16 sends signals to the elevator position indicator 10 so that the segmented display 12 will show the floor location of the elevator car using an alpha-numeric character.

A seven segment display is all that is required if the floor locations of the elevator include a lobby and numerically numbered floors. The sixteen segment display is required if alphabetic characters such as "G" for garage or "M" for mezzanine are to be displayed.

The overall elevator system 11 operates at some operational voltage and current type. The present invention position indicator 10 provides a display that can function at multiple operational voltages and current types. As such, the elevator position indicator 10 can be added to a variety of existing elevator systems.

Figure 2:
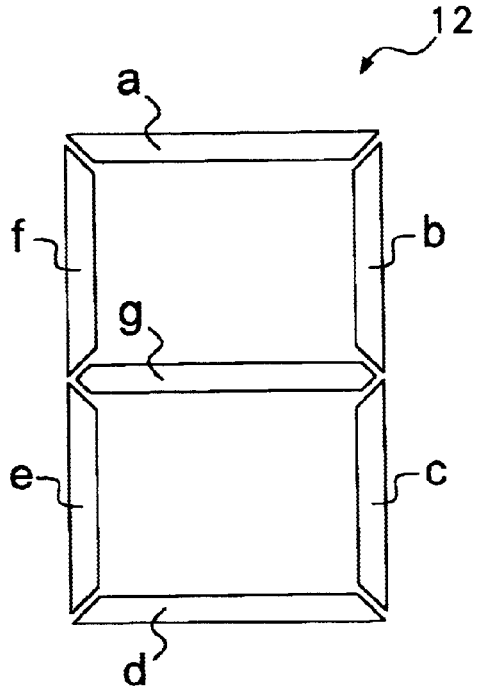
Fig. 2 (PRIOR ART)
FIG. 2 is a schematic of a seven segment display.

Referring to FIG. 2, a schematic is shown for the seven segment display 12. The seven segment display 12 has seven segments. The seven segments are labeled with the labels a, b, c, d, e, f and g, respectively. Each segment of the display is either an LED or an energizable segment of an LCD, depending upon the type of display used. To create the number "1", segments b and c are energized. To create the number "2", segments a, b, d, e and g are energized. Other letters and numbers can be created by referring to the following table, where the x's indicate the segments that are energized.

TABLE 1

| | Segment | | | | | | |
|---|---|---|---|---|---|---|---|
| Number | a | b | c | d | e | f | g |
| 1: | | X | X | | | | |
| 2: | X | X | | X | X | | X |
| 3: | X | X | X | X | | | X |
| 4: | | X | X | | | X | X |
| 5: | X | | X | X | | X | X |
| 6: | X | | X | X | X | X | X |
| 7: | X | X | X | | | | |
| 8: | X | X | X | X | X | X | X |
| 9: | X | X | X | X | | X | X |
| 0: | X | X | X | X | X | X | |
| L: | | | | X | X | X | |
| P: | X | X | | | X | X | X |

Figure 3:
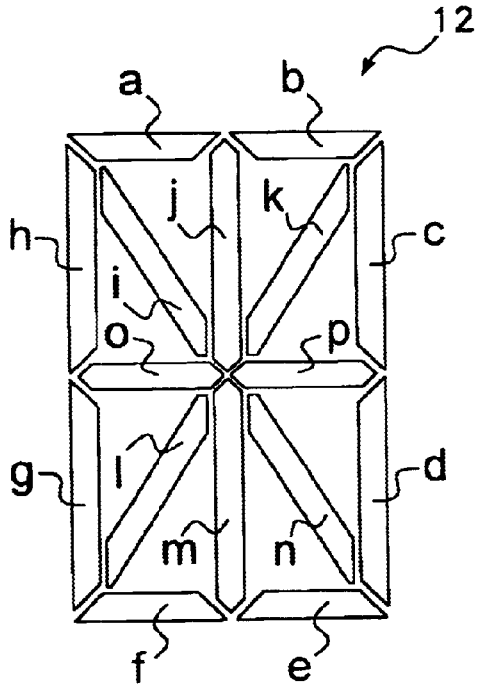
Fig. 3 (PRIOR ART)
FIG. 3 is a schematic of a sixteen segment display.

Referring to FIG. 3, a schematic is shown for the sixteen segment display 15. The sixteen segment display 15 has sixteen segments. The sixteen segments are labeled with the labels a, b, c, d, e, f, g, h, i, j, k, l, m, n, o and p, respectively. Such a sixteen segment display 15 is capable of producing any alpha-numeric character. For example, to produce the letter "M", segments c, d, h, g, i and k are energized. To produce the letter "G" segments a, b, d, e, f, g, h, and p are energized.

The sixteen segment display 15 can be used. However, for the sake of simplicity, it will be assumed that the seven segment display of FIG. 2 is being used in the remaining description of the present invention.

Figure 4:
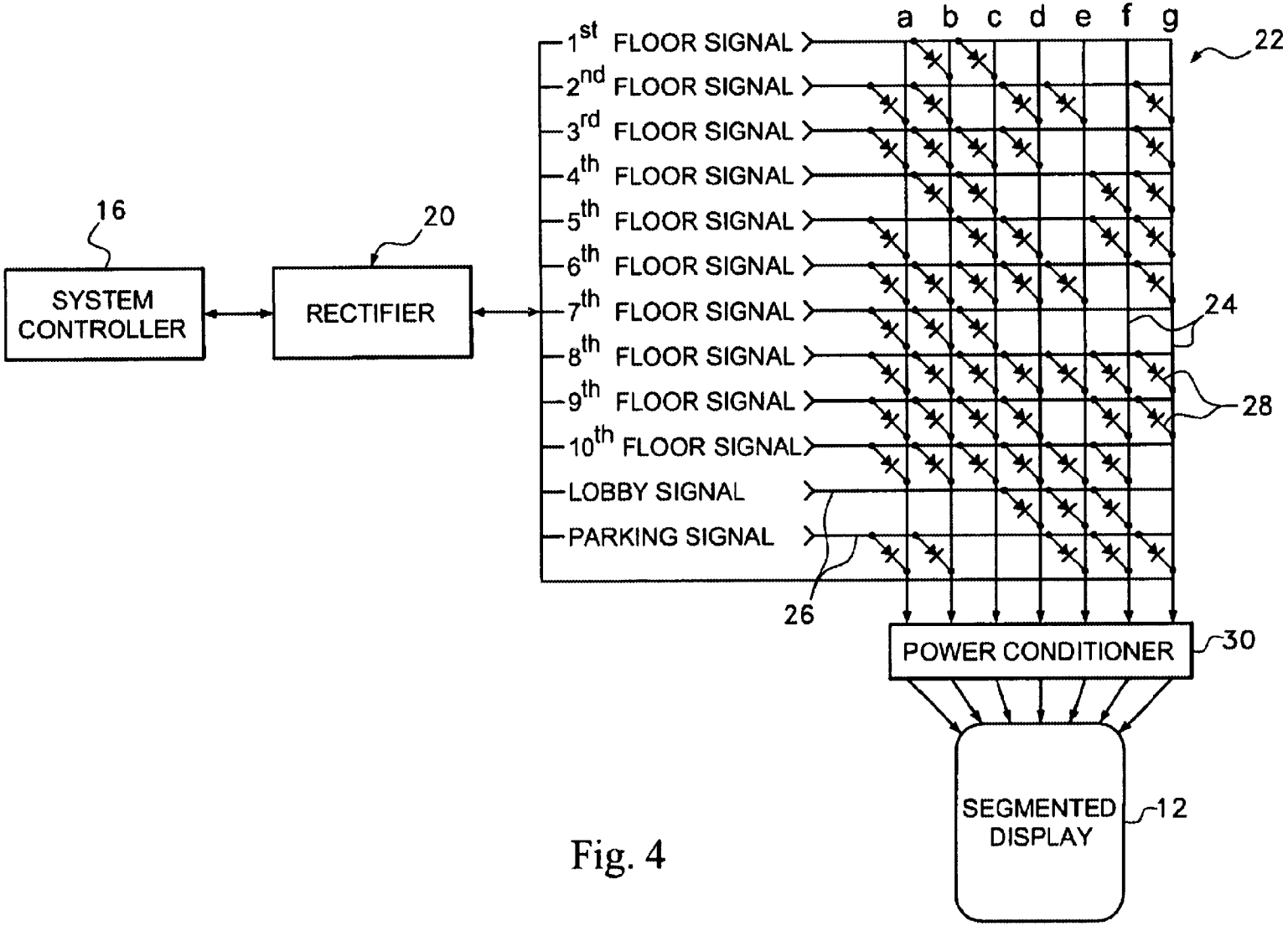
FIG. 4 is a schematic of an elevator position indicator that utilizes twelve possible location signals.

Referring now to FIG. 4, a wiring schematic is shown that illustrates the major components of the elevator position indicator. The elevator position indicator preferably includes a rectifying circuit 20 that receives either AC or DC signals from the systems controller 16 of the overall elevator system. The rectifying circuit 20 converts the signals into direct current in a manner which will later be explained with reference to FIG. 5. If the signals received from the systems controller 16 of the overall elevator system are already using direct current, the rectifying circuit 20 need not be present.

The signals produced by the elevator systems controller are position signals that indicate the position of an elevator car in the elevator system. After location signals from the elevator's system controller are rectified, the location signals pass into a display drive circuit 22. The purpose of the display drive circuit 22 is to drive the segmented display 12 and ensure that the segmented display 12 displays the proper alpha-numeric character as instructed by the received location signal.

The display drive circuit 22 contains seven vertical lines 24 which correspond to the seven segments of the segmented display 12. Also shown in FIG. 4 are twelve horizontal lines 26 that correspond to the twelve possible display commands that can be produced by the elevator's system controller 16. The display commands are the numerals "0" through "9" and the letters "P" and "L" as is listed above in Table 1.

Disposed between the various vertical lines 24 and horizontal lines 26 of the drive circuit 22 are diodes 28 that control the direction of current flow. In FIG. 4, it can be seen that the horizontal line for the received location signal for the number "1" is coupled with diodes to vertical line "b" and vertical line "c". This shows that to produce the number "1" the "b" and "c" segments (FIG. 2) in the seven segment display 12 are to be lit. As such, it will be understood that the drive circuit 22 of FIG. 4 corresponds to Table 1 with regard to what segments of the seven segment display 12 are to be energized to produce different alpha-numeric characters.

After the drive circuit 22 directs the various location signals to the proper pathways, as represented by the vertical lines 24, the location signals pass through a power conditioning circuit 30. The power conditioning circuit.30 ensures that the current of the location signals is not above the capacity of the segmented display 12. The details of the power conditioning circuit 30 will later be described with reference to FIG. 5.

Lastly, the location signals are received by the segmented display 12. Depending upon which of the twelve possible location signals are received, the segmented display will produce one of the twelve alpha-numeric characters listed in Table 1.

The wiring schematic shown in FIG. 4 would be used on an elevator operating in a building having a parking garage, a lobby and ten floors. This would provide the twelve possible command signals listed in Table 1. However, the system can be used for elevator systems having any other number of floors.

Figure 5:
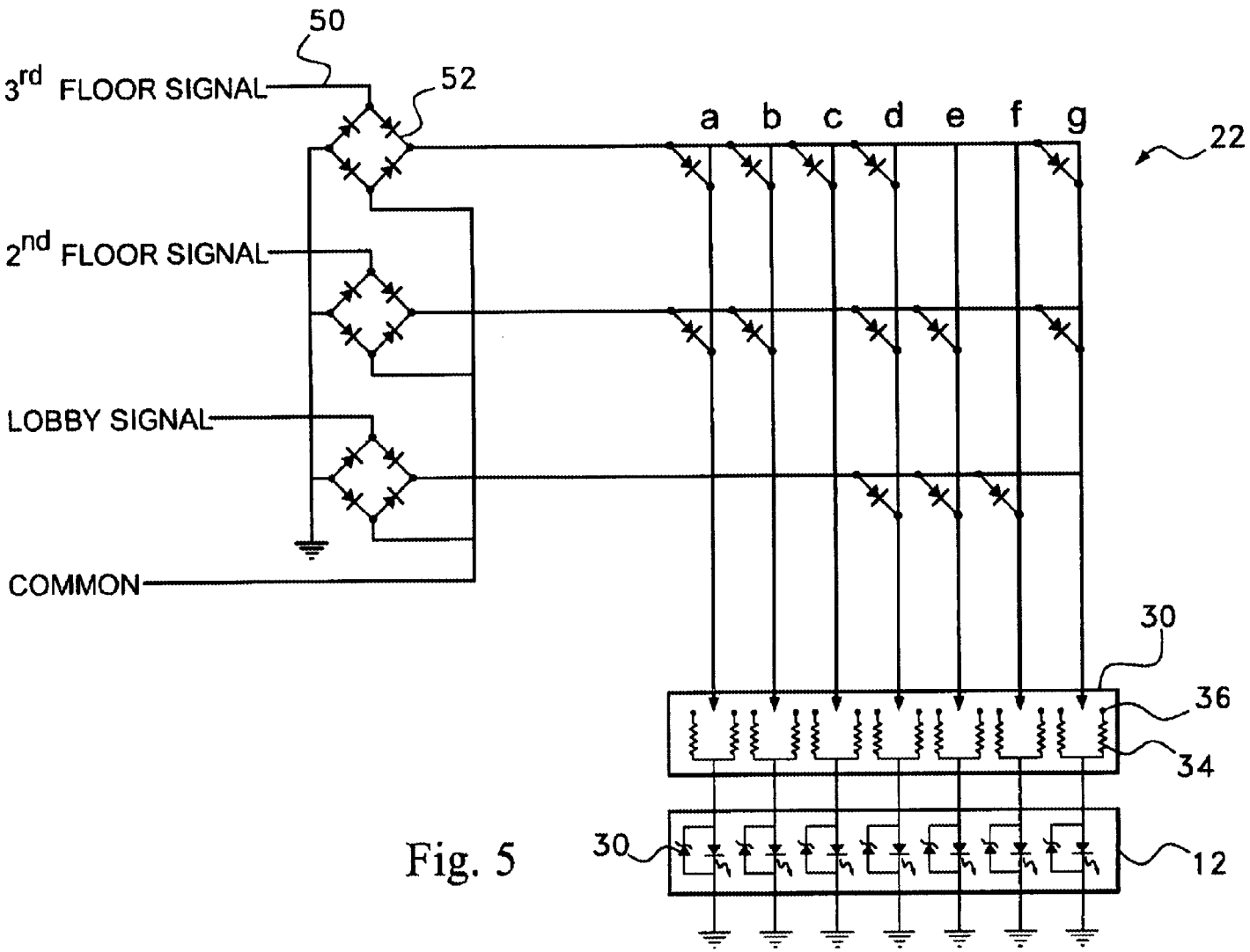
FIG. 5 is a schematic of an elevator position indicator that utilizes three possible location signals.

Referring to FIG. 5, the present invention system is configured for an elevator that services only three floors. The elevator has three levels represented by "L" for the lobby, "2" for the second floor and "3" for the third floor. As such, the systems controller of the elevator produces one of three location signals depending upon the position of the elevator car. Those three signals are "L", "2" and "3". A control wire 50 is, provided for each of the possible location signals.

If the location signal produced by the systems controller of the elevator is a direct current signal, then the signal need not be rectified. However, if the position signals are in alternating current, the signals must be rectified. In FIG. 5, an exemplary embodiment of a rectifying scheme is shown. In the embodiment of FIG. 5, a full wave bridge rectifier 52 is provided along each control wire 50. The full wave bridge rectifiers 52 rectify the A/C location signals. In circuit design, there are many circuits that perform the same function as a full wave bridge rectifier, and such circuits can be substituted for the full wave bridge rectifiers shown.

The output voltages of each of the full wave bridge rectifiers 52 lead to the display driver 22. Previously in FIG. 4, a display driver was shown that was capable of producing twelve alpha-numeric characters. In FIG. 5, the display driver 22 is capable of producing only three alpha-numeric characters because the elevator system only has three floor levels. In FIG. 5, the first row of the display driver is configured to produce the letter "L" on a seven segment display 12. The second row of the display driver is configured to produce the number "2" on a seven segment display 12. Lastly, the third row of the display driver 22 is configured to produce the number "3" on a seven segment display 12.

The display driver. 22 has seven outputs so as to drive a seven segmented display 12. The outputs of the display driver lead into a power conditioning circuit 30. In the shown embodiment, the power conditioning circuit utilizes a zener diode 32, a plurality of resistors 34 and dip switches 36 in series with each of display driver outputs. The zener diodes are illustrated within the a seven segmented display 12 but should be considered part of the power conditioning circuit 30. The dip switches 36 change which of the resistors 34 are in series with the outputs of the display driver 22. The resistors 34 have different resistance values. As such, by using the dip switches 36, a resistor can be selected that reduces the voltage of the display signals into the operational range of the seven segment display 12. Consequently, by altering the dip switch settings, the system can be altered to operate within a wide range of supply voltages.

The outputs of the power conditioning circuit 30 lead into the seven segment display 12. The seven segment display 12 produces an "L", "2" or "3" depending upon the location signal received by from the elevator's systems controller.

Figure 6:
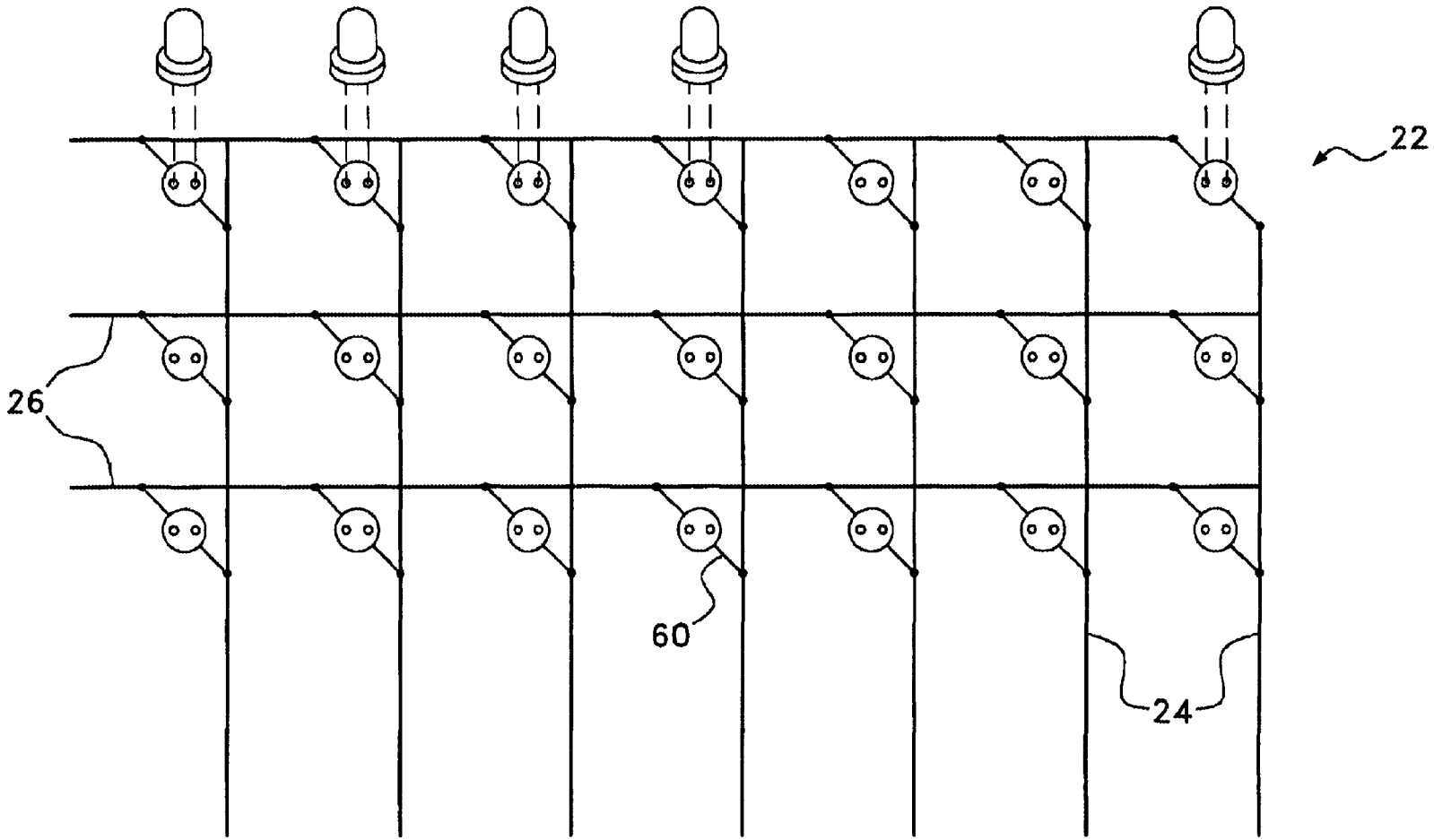
FIG. 6 is a schematic of a segment of display drive circuit that uses connector ports that receive voltage steering devices.

In the schematics shown in FIG. 4 and FIG. 5, it appears that the various diodes 28 in the display drive circuit 22 are hard wired to the vertical lines 24 (FIG. 4) and horizontal lines 26 (FIG. 4). This need not be the case in all applications. Referring now to FIG. 6, a segment of a display drive circuit 22 is shown having vertical lines 24 and horizontal lines 26. Each and every horizontal line 26 is interconnected to each and every vertical line 24 through use of a junction line 60. A diode plug connector 62 is disposed within each junction line 60. The diode plug connectors 62 are sized to selectively receive and retain a diode 28. When no diode is present in a diode plug connector 62, no current flows through the junction line 60 that supports that diode plug connector. However, when a diode 28 is present within the diode plug 60, current flows through both the junction line 60 and that diode 28.

As such, it will be understood that by selectively placing different diodes. 28 into different diode plug connectors, a technician can customize the display driver circuit to produce a wide variety of different alpha-numeric characters in response to different incoming signals from the elevator's systems controller 16 (FIG. 4).

The present invention elevator position indicator can be used in a wide range of voltages and in applications with either alternating current or direct current. The elevator position indicator uses commonly available parts. As such, the elevator position indicator can be manufactured very inexpensively and can be readily repaired.

It will be understood that the specifics of the elevator position indicator described above illustrates only exemplary embodiments of the present invention. A person skilled in the art can therefore make numerous alterations and modifications to the shown embodiment utilizing functionally equivalent components and circuit layouts to those shown and described. All such modifications are intended to be included within the scope of the present invention as defined by the appended claims.

What is claimed is:

1. In an elevator assembly that produces locations signals, from a predetermined number of possible location signals, that are indicative of the location of an elevator car, a position indicator display system, comprising:

a segmented display having a first number of segments and a predetermined operational power requirements;

a display driver coupled to said segmented display, said display driver containing a plurality of output signal lines that correspond in number to said first number of segment, wherein said display driver receives a location signal and utilizes the location signal to produce a drive signal that drives said segmented display and produces an alpha-numeric character indicative of the location signal;

at least two pathways disposed between each said output signal line and said segments of said segmented display, where each of said pathways has different resistance value;

a switch coupled to each of said output signal lines for selectively connecting each of said output signal lines in series with a selected one of said at least two pathways, thereby enabling said drive signal to be selectively conditioned by the resistance value of a selected pathway to fall within said operational power requirements of said segmented display.

2. The system according to claim 1, wherein said display driver contains a plurality of input signal lines that correspond in number to the predetermined number of possible location signals, wherein each of said input signal lines is dedicated to receiving one of the possible location signals.

3. The system according to claim 1, wherein each of said input signal lines is connected to at least some of said output signal lines with current steering devices in a predetermined pattern.

4. The system according to claim 1, further including a plurality of connector ports, each of said connector ports being sized to receive a removable current steering device therein, wherein a connector port is disposed between each of said input signal lines and each of said output signal lines.

5. The system according to claim 4, further including a plurality of current steering devices, said current steering devices being selectively positionable in said connector ports, wherein each current steering device electrically connects one of said input signals lines to one of said output signal lines when positioned in a connector port.

6. The system according to claim 3, wherein the pattern of where said output signal lines connects to each said input signal lines is determinate of said alpha-numeric characters produced by said drive circuit for the location signals received by the input signal lines.

7. The system according to claim 5, wherein said current steering devices selectively positioned in said connector ports is determinate of said alpha-numeric characters produced by said drive circuit for the location signals received by the input signal lines.

8. The system according to claim 2, wherein the location signals are in alternating current and said system further includes a circuit for rectifying the location signals.

9. The system according to claim 8, wherein said circuit for rectifying the location signals includes a rectifier coupled to each of said input signal lines.

10. The system according to claim 9, wherein said rectifier is a full wave bridge rectifier.

11. The system according to claim 1, wherein said segmented display is selected from a group consisting of a seven segment display and a sixteen segment display.

12. In an elevator system that produces a plurality of position location signals, a method of displaying alpha-numeric characters indicative of the position location signals, comprising the steps of:

providing a segmented display having a first number of segments and a predetermined operational power requirements;

converting a position location signal into a display drive signal;

providing switches, wherein one switch is provided for each of said segments of said segmented display;

providing multiple pathways to each of said segments of said segmented display, wherein each of said segments has a different resistance;

selecting one of said multiple pathways for said display drive signal to reach each of said segments utilizing said switches, wherein said display drive signal is reduced in power and falls within said predetermined operational requirements, and driving a segmented display with the display drive signal, wherein the segmented display produces an alphanumeric character indicative of the display drive signal.

13. The method according to claim 12, wherein said position location signal is in alternating current and said method further includes the step of rectifying said position location signal.

14. The method according to claim 12, wherein said step of converting a position location signal into a display drive signal includes providing a drive circuit having a plurality of input lines and a plurality of output lines, wherein each of said input lines is coupled to a unique combination of said output lines with current steering devices.

15. The method according to claim 12, wherein said segmented display is selected from a group consisting of seven segment displays and sixteen segment displays.

* * * * *